United States Patent [19]

Grandori

[11] 4,192,556

[45] Mar. 11, 1980

[54] TUNNEL BORING MACHINES

[75] Inventor: Carlo Grandori, Rome, Italy

[73] Assignee: The Robbins Company, Seattle, Wash.

[21] Appl. No.: 934,978

[22] Filed: Aug. 18, 1978

Related U.S. Application Data

[63] Continuation of Ser. No. 761,351, Jan. 21, 1977, abandoned.

[30] Foreign Application Priority Data

Feb. 2, 1976 [IT] Italy ..... 47913 A/76

[51] Int. Cl.[2] ..... E21D 9/04; E21D 9/08

[52] U.S. Cl. ..... 299/56; 299/58; 299/90

[58] Field of Search ..... 299/56, 31, 90, 58; 175/102, 315, 312, 99

[56] References Cited

U.S. PATENT DOCUMENTS

| | | | |
|---|---|---|---|
| 848,107 | 3/1907 | Karns | 299/90 |
| 883,137 | 3/1908 | Karns | 299/90 |
| 3,005,627 | 10/1961 | Tinlin | 175/94 X |
| 3,382,002 | 5/1968 | Tabor | 299/90 |
| 3,413,033 | 11/1968 | Clark | 299/90 |

OTHER PUBLICATIONS

Proceedings of 1976 Rapid Excavation and Tunneling Conference, Chapter 21, Grandori, pp. 355-376, 6-1-4-76.

*Primary Examiner*—William F. Pate, III

*Attorney, Agent, or Firm*—Graybeal & Uhlir

[57] ABSTRACT

A machine for mechanical tunnel boring, of the rotating cutter head type, comprising a grid rigid with the cutter head, parallel to the theoretical boring surface, provided with a set of void spaces wherefrom the cutting tools slightly project, said void spaces having a size corresponding to the optimum dimensions of the fragment of mined material.

6 Claims, 9 Drawing Figures

FIG. 7
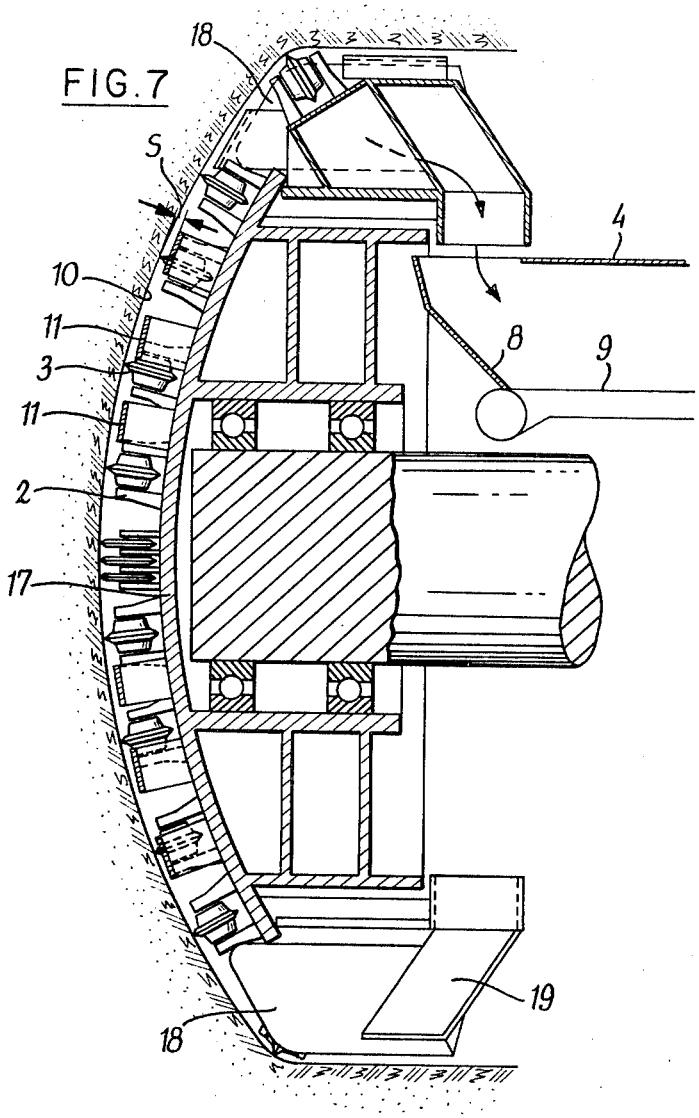
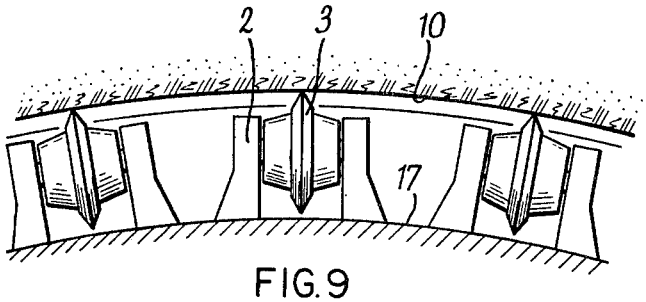
FIG. 9

TUNNEL BORING MACHINES

This is a continuation of application Ser. No. 761,351, filed Jan. 21, 1977 now abandoned.

The invention relates to an improvement in the present machines for the mechanical tunnel boring, and particularly in those machines which by a single tool, called cutter head, are boring the entire cross sectional area of the tunnel, said head revolving about an axis coincident with that of the tunnel.

Up to now, the possibility of satisfactory use of said machines is restricted to the grounds the boring front of which is self-supporting.

The purpose of this invention is that of embodying a device capable of being applied to whatsoever rotary cutter head either already constructed, or to be constructed, allowing the cited machines to be used also where the boring front consists of an entirely or partially not self-supporting ground.

As it is known to the persons skilled in the art, the cutter heads of the related machines are provided with tools of various kinds. For the soft rocks said tools consist generally of cutters having various shapes; for the hard rocks the tools are generally discs idly mounted on the cutter head, and rotating about axes located according to the radii of the head itself. Each disc is provided with one or more rings made of very strong and hard material, with sharp edged corners, or with embedded buttons of hard material.

The tools of the cutters for soft rocks will scrape the front and are boring it by an action like that of a "ripper", or of a lathe or planing tool.

The tools for hard rocks operate by concentrating on the rock, through the sharp cornered ring or the buttons, a heavy concentrated load breaking the overloaded zone by internal stress.

In both cases, namely for the soft rocks and for the hard rocks, in stable and uniform conditions of the ground, the excavated material consists of elements the maximum sizes of which are about $2\times8\times15$ cms for the hard rocks, while said sizes increase for the soft rocks up to $15\times20\times30$ cms, and sometimes also more.

The distance measured along the axis of rotation from the boring surface to the surface of the tool carrying structure has always a remarkable value, also for constructive requirements, and anyway sensibly greater than that of the greatest element produced by the boring operation.

The excavated material can fall between the tool support, namely the rotary cutter head, and the tunnel face, and is collected by a set of shovels, of which the head is provided, and is carried by these shovels on a continuous conveyor belt, carrying said material behind the cutter head.

By an arrangement of this kind, in various applications, the occurrence of the drawbacks as follows frequently has been noted in all types of cutter heads used up to day.

When the boring front is unstable, and collapses, partially or entirely, both in the cutter head for soft rocks and in those for hard rock, the material which moves away from the front invades the space between said front and the cutter head increasing the resistance against rotation up to a possible jamming thereof.

In other cases, the volume of the product of the boring operation is greater than the volume corresponding to the forward movement and to the bored section. so that recesses will be generated, with the risk of collapsing and setting of the ground. In these cases it is compulsory to stop the operation of the cutter head and either it will be necessary to carrry out reinforcing works, or it will be required to progress before the cutter head with conventional systems, until the difficulties will be overcome.

Another very frequent drawback, which occurs for instance in the cracked rocks or in rocks including alternated layers of soft rocks and hard rocks, is the breakaway from the front, also under the action of the cutter heads themselves, of blocks having such dimensions that the pickup shovels cannot take said materials and/or the predisposed means cannot remove said mined materials.

Thereby damages will be originated for the tools and their supports, and/or to the conveying and removing means, with the consequent discontinuances for the manual removal of the blocks or the repair of the damages.

This invention aims in fact to obviate these drawbacks reducing as much as possible their occurrence.

According to this invention it is provided of mounting on the cutter head a shield or grid rigid therewith, parallel to the theoretical boring surface, provided with a set of void spaces from which slightly project the crushing tools or cutting elements, said void spaces corresponding to the "optimum" sizes of the fragments of excavated material.

Also according to the present invention said grid consists preferably of a set of annular bands, concentrical with the axis of rotation of the cutterhead and so spaced apart from one another as to allow the passage of excavated material, the size of which is less than a prefixed value. Also the distance of said bands from the body of the cutter head is related to said preestablished size.

This invention will be now described with reference to the attached drawings, showing by way of non limitative example one preferred embodiment of the invention itself.

In the drawings:

FIG. 7 is a cross sectional view taken along the line VII—VII of FIG. 6;

FIG. 9 shows a cross sectional view taken along the plane IX—IX of FIG. 8.

Figure 1:
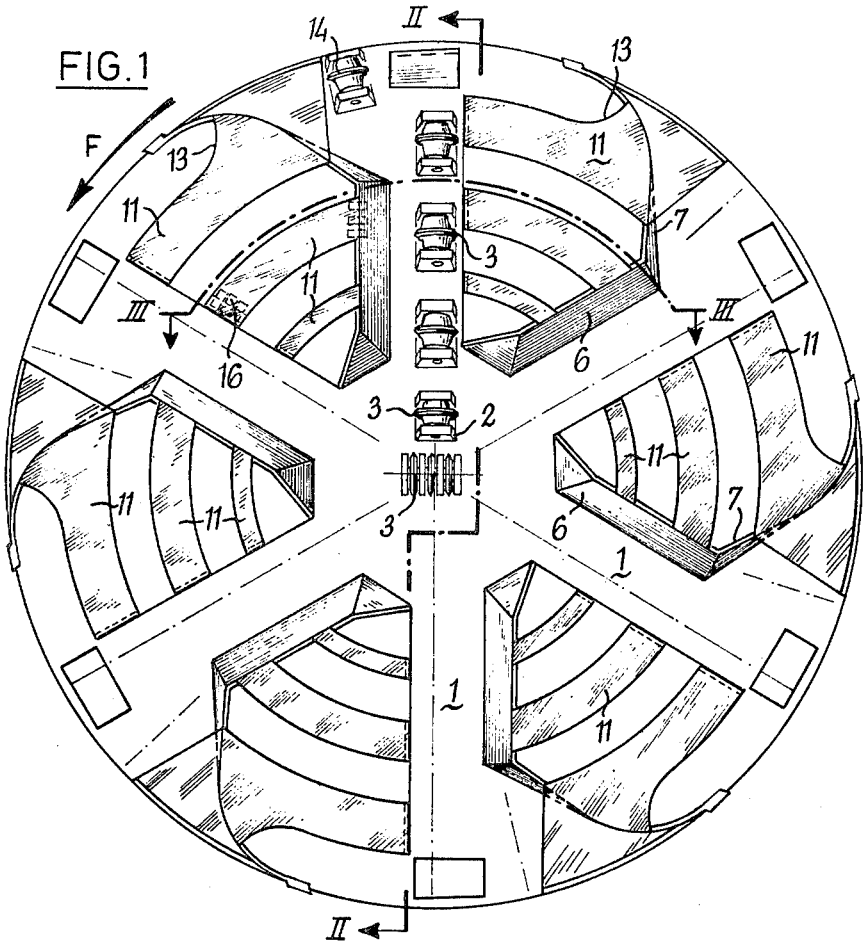
FIG. 1 is a front elevation view of a boring cutter head, having a spoke structure, and equipped with the device according to this invention.
Figure 3:
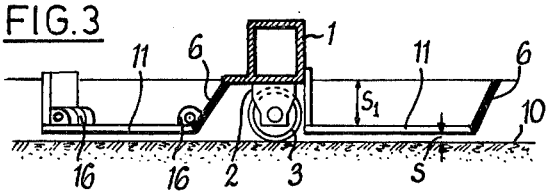
FIG. 3 is a cross sectional view taken along the line III—III of FIG. 1.
Figure 2:
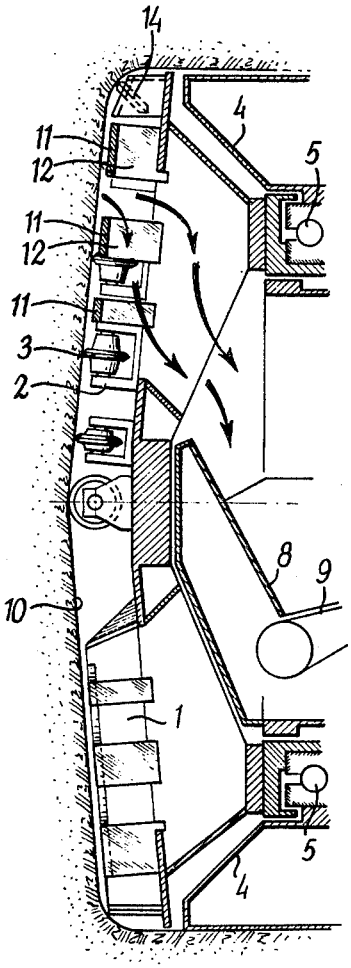
FIG. 2 is a cross sectional view taken along the line II—II of FIG. 1.

With reference to FIGS. 1 to 3, the numeral 1 denotes the spokes of an "open" type cutter head. The spokes 1 have a box-like structure, and each of them is provided with a set of fork-like supports 2 carrying crushing or cutting rollers or discs 3, idly mounted on said supports, and rotatable about axes radially located with respect to the cutter head.

Said cutter head rotates as shown by the arrow F and is connected to the internal stationary structure 4 by means of the rolling bearings 5.

The material coming from the boring face 10 is taken by the radial shovels 6 inclined towards said face 10 and by the curvilinear peripheral chutes 7 carried by said shovels and is conveyed, as shown by the arrows of FIG. 2, into the hopper 8, which is a part of the stationary structure downstream of the cutter head. At the bottom of the hopper 8, a belt conveyor 9 carries the mined material out of the tunnel.

This invention provides for a grid consisting of a concentrical set of metal annular rings 11, having an adequate thickness, subdivided into sectors, welded or fixed to the ends of the radial shovels 6 and to the supports 12 of FIG. 2. As it is clearly shown in this figure, the position of the grid 11 with respect to the base of the cutterhead is such that from the grid itself will project only the cutting discs 3. In correspondence with the peripheral zone of the cutter head, the annular band 11 is shaped as shown in 13 in order to protect the peripheral zone when the outer discs 14 operate.

Figure 4:
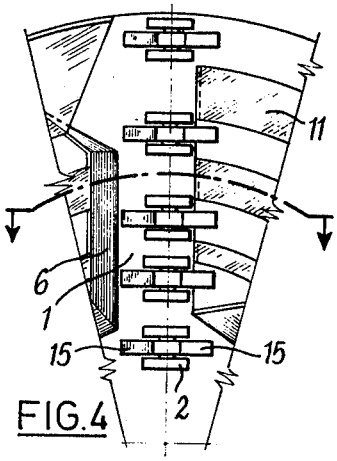
FIGS. 4 and 5 show details of a variant of the cutter head of FIG. 1, in partial elevation, and in cross sectional view taken along the line V—V of FIG. 4, respectively.
Figure 5:
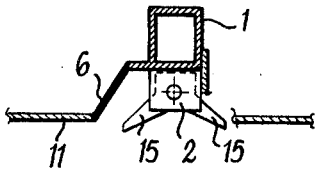

FIGS. 4 and 5 where like numerals indicate the same parts already described and indicated with these numerals, the grid according to this invention is applied to one cutter head for soft rocks, and is provided with the pairs of cutters 15 instead of the crushing discs.

One or more sectors of the grid 11 can be removable in order to allow the passage of the persons, and of the spare parts which must pass through the cutter head, as well as for allowing the periodical inspections to the tunneling front 10. By way of example, FIGS. 1 and 3 show a system consisting of two sets of slots 16 into which is inserted a pair of locking pins.

FIGS. 6 to 9 show the grid according to this invention as applied to a "closed" type cutter head, consisting of a part spherical member 17 provided a crown of shovels 18 and 19 conveying upwards the mined material, which is then discharged on the already described conveyor 9.

Figure 8:
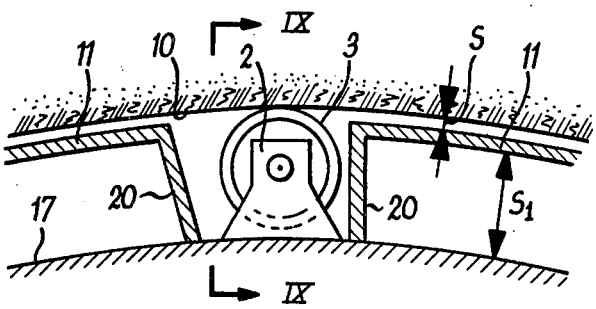
FIG. 8 is a cross sectional view taken along the plane VIII—VIII of FIG. 6, in an enlarged scale.

In this case, as no radial shovel exists, the annular elements 11 of the grid are fixed to the shield 17 by pairs of supports 20, as clearly shown in FIG. 8.

For both described solutions, the mutual position between the grid 11 and the tool 3 must be such that the projection S (FIG. 8) of the tools or discs 3 from the grid will be minimum, taking account of the limits as follows: namely, the limit for which the efficiency of the machine is still normal in the stable and uniform front where the already cited drawbacks do not occur, and the limit of the minor dimension of the biggest element as produced by the boring operation in normal conditions, (stable, non-blocky front).

The dimension of the clear part of the passage between the bands 11 of the grid, as radially measured, must not be greater than the maximum dimension of the element which can pass in the conveying means, and must not be such as to hinder the passage of the mined material in normal situation.

Downstream of the bands 11 of the grid, large passages $S_1$ must be arranged for the material which passes directly through the grid, and/or for the material which will be loaded by the shovels mounted on the cutter head.

By the above described grid device, when the entire front of tunneling or part thereof tends to collapse, it will be supported by the annular bands 11 of the grid, while the tools projecting therefrom will cause the crushing of the bigger pieces and the passage of the little pieces. The amount of the material passing through the grid will be limited, reducing the risk of the passage of a volume greater than that corresponding to the advancement of the machine.

Likewise, when from the boring from breakaway blocks having remarkable dimensions tend to breakaway, said blocks are held in place by the bars of the grid until the tools will gradually reduce said blocks to such dimensions as to allow their passage through the grid.

Figure 6:
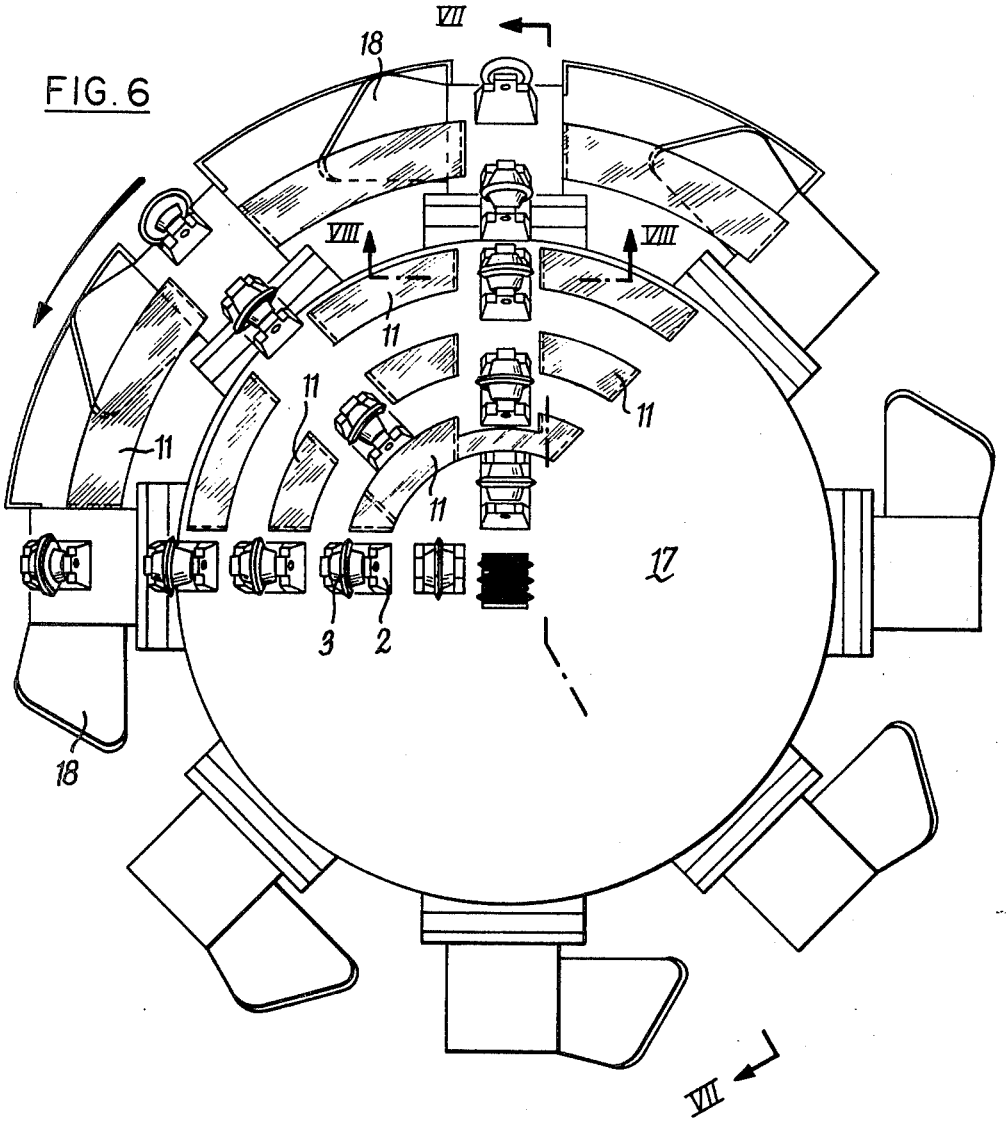
FIG. 6 is a view similar to FIG. 1, showing this invention when applied to a closed type cutter head.

As it is evidently shown in FIGS. 1, 6 and 7, the grid according to this invention serves the shielding function also in respect of the collecting members (buckets) for the mined material, where said members operate directly in correspondence with the tunneling front.

The present invention has been described in one embodiment at present preferred, being however understood that constructive variations might be adopted in practice without departing from the scope of the present industrial privilege.

Having thus described the present invention, what is claimed is:

1. A tunneling machine cutterhead of the rotary type which in use is advanced in a direction coincident with its axis of rotation, said cutterhead comprising:

a plurality of forwardly directed cutters having cutting portions for cutting concentric kerfs in a tunnel face, a plurality of passageways through which excavated materials pass, a rigid grid structure having a plurality of tunnel face contacting, radially spaced apart breasting rings, said breasting rings being concentric with the axis of rotation of the cutterhead and defining the forward face of the cutterhead, said radially adjacent breasting rings defining annular openings radially between them of a width corresponding to the optimun dimention of fragments of excavated material, said breasting rings being positioned such that all excavated material must pass through a said opening before entering a said passageway, said cutters being mounted on said cutterhead rearwardly of said grid structure so that the cutting portion of each of said cutters projects slightly forwardly of said breasting rings to permit said breasting rings to support the tunnel face as said cutter cutting portion penetrates into the tunnel face.

2. A tunneling machine cutterhead according to claim 1, wherein the cutters are roller type cutters having peripheral cutting portions which project slightly forwardly of the front face of the grid structure.

3. A tunneling machine cutterhead according to claim 1, in which the grid structure is divided into sections one of such sections is removable to provide an access avenue for inspection of the region forwardly of the cutterhead.

4. A tunneling machine cutterhead according to claim 1, wherein said cutterhead further comprises:

a plurality of radial spokes radiating outwardly from the axis of rotation of said cutterhead and disposed rearwardly of said breasting rings;

axial passageways located between said spokes through which excavated materials pass wherein a substantial number of said cutters are mounted along the length of each of said spokes; and wherein said breasting rings are mounted on said cutterhead to span across said axial passageways.

5. A tunneling machine cutterhead according to claim 4, wherein said cutterhead further comprises a shovel wall disposed along the leading edge of each of said spokes, said shovel wall being inclined rearwardly from said breasting rings to intersect with said corresponding spoke to thereby direct excavated materials which are traveling circumferentially along said breasting rings, rearwardly into said annular openings and through said axial passageways.

6. A tunneling machine cutterhead according to claim 1, wherein each of said breasting rings is of substantially uniform width; and each of said annular openings defined by said adjacent breasting rings is of substantially uniform width.

* * * * *